US008689945B2

(12) United States Patent
Arai et al.

(10) Patent No.: US 8,689,945 B2
(45) Date of Patent: Apr. 8, 2014

(54) DEVICE FOR PREVENTING TRAVEL OF AN ELEVATOR WITH ITS DOORS OPEN

(75) Inventors: Hideki Arai, Chiba-ken (JP); Yasunobu Uchino, Chiba-ken (JP); Shunji Imai, Chiba-ken (JP)

(73) Assignee: Otis Elevator Company, Farmington, CT (US)

( * ) Notice: Subject to any disclaimer, the term of this patent is extended or adjusted under 35 U.S.C. 154(b) by 250 days.

(21) Appl. No.: 13/124,718

(22) PCT Filed: May 8, 2009

(86) PCT No.: PCT/US2009/043245

§ 371 (c)(1),
(2), (4) Date: Apr. 18, 2011

(87) PCT Pub. No.: WO2010/059265

PCT Pub. Date: May 27, 2010

(65) Prior Publication Data

US 2011/0198159 A1 Aug. 18, 2011

(30) Foreign Application Priority Data

Nov. 20, 2008 (JP) ..... 2008-296203

(51) Int. Cl.
*B66B 5/26* (2006.01)

(52) U.S. Cl.
USPC ..... 187/355

(58) Field of Classification Search
CPC ..... B66B 5/26; B66B 13/14
USPC ..... 187/355, 331, 280, 314
See application file for complete search history.

(56) References Cited

U.S. PATENT DOCUMENTS

| | | | | |
|---|---|---|---|---|
| 1,495,242 | A * | 5/1924 | Boze | 187/354 |
| 3,252,547 | A * | 5/1966 | Hornedo | 187/274 |
| 4,101,007 | A | 7/1978 | Magee | |
| 5,730,254 | A | 3/1998 | Nguyen | |
| 7,073,632 | B2 | 7/2006 | Martin | |
| 7,137,484 | B2 | 11/2006 | Martin | |
| 2004/0188184 | A1 | 9/2004 | Kocher et al. | |
| 2006/0243534 | A1 | 11/2006 | Miller et al. | |

FOREIGN PATENT DOCUMENTS

| | | | |
|---|---|---|---|
| CN | 101134547 | A | 3/2008 |
| CN | 201102843 | Y | 8/2008 |
| JP | 532374 | | 4/1993 |
| JP | 10059662 | A | 3/1998 |
| JP | 2008044782 | A | 2/2008 |
| JP | 2008184271 | A * | 8/2008 |

(Continued)

OTHER PUBLICATIONS

Machine Translation of JP 1059662.*

(Continued)

*Primary Examiner* — William E Dondero
*Assistant Examiner* — Diem Tran
(74) *Attorney, Agent, or Firm* — Carlson, Gaskey & Olds

(57) ABSTRACT

An exemplary device for preventing travel of an elevator car when a car door is open includes a receiver that remains in a fixed position relative to a hoistway wall. A stop member moves responsive to the car door moving toward an open position such that the stop member engages the receiver to prevent movement of the elevator car when the door is open.

19 Claims, 10 Drawing Sheets

(56) References Cited

FOREIGN PATENT DOCUMENTS

| | | | | |
|---|---|---|---|---|
| JP | 2008201494 | A | | 9/2008 |
| JP | 2009096561 | A | * | 5/2009 |
| JP | 2009203068 | A | | 9/2009 |

OTHER PUBLICATIONS

International Search Report and Written Opinion of International Searching Authority for International application No. PCT/US2009/043245 mailed Sep. 27, 2010.

International Preliminary Report on Patentability for International application No. PCT/US2009/043245 mailed Jun. 3, 2011.

* cited by examiner

DEVICE FOR PREVENTING TRAVEL OF AN ELEVATOR WITH ITS DOORS OPEN

CROSS REFERENCE TO RELATED APPLICATION

This application claims priority to Japanese Patent Application No. 2008-296203, which was filed on Nov. 20, 2008.

BACKGROUND

Japanese Kokai Patent Application No. 2007-55691, for example, discloses a device for preventing travel of an elevator car with the doors open. In the case of the technology described in that document, a door detection switch detects the state of the doorway, a car position detector detects the position of the car, and a fall-prevention means detects travel with the doors open based on outputs from them. A rope gripper, which is used to hold a rope for hanging the car, is activated when said fall-prevention means has detected travel of the car with its doors open in order to prevent further traveling of the car.

One drawback of such an arrangement is that it relies upon software-based processing and if it fails, the car may be moveable with the doors open.

SUMMARY

An exemplary device for preventing travel of an elevator car when a car door is open includes a receiver that remains in a fixed position relative to a hoistway wall. A stop member moves responsive to the car door moving toward an open position such that the stop member engages the receiver to prevent movement of the elevator car when the door is open.

When the doors are opened as the car arrives at a servicing floor, the stop member engages with the receiver while the doors are opening before the car-side doorway is fully open; thereby travel of the car is prevented while the car-side doorway is partially or fully open due to the engagement of the stop member with the receiver.

In one example, when the stop member is installed on the car door, whereby the stop member moves along with the car door upon opening/closing, travel of the car with the doors open can be reliably prevented using an extremely simple structure.

In one example, a direct-acting guide means, which is used to guide the stop member to move in the horizontal direction relative to the car door, and a biasing means, which is used to apply a biasing force to the stop member in the direction of opening of the door, are installed respectively between the stop member and the car door. A restricting member prevents further advancement of the stop member past a limit position where it is engaged with the receiver. The stop member reaches the limit position at some intermediate point during the opening operation of the car door, and the car door fully opens subsequently while moving relative to the stop member.

In one example, the amount of advancement of the stop member toward a hoistway sidewall can be reduced when the car-side doorway is fully opened.

In some examples, it is also feasible for the stop member to be supported on the frame of the car. This is advantageous in terms of strength because the restricting force for preventing travel of the car with its doors open is borne by the car frame.

In one example while a biasing means, which is used to apply a biasing force to the stop member in the direction of retreat, is installed between the stop member and the frame of the car, a manipulating body, which is used to push the stop member in the direction of advancement, is installed on the car doors, whereby the stop member engages with the receiver when it is pushed by the manipulating body, which moves along with the car doors, when said car doors are opened.

In one example, the stop member is allowed to advance only by a prescribed amount while it is cam-driven by a manipulating body installed on the car doors during the opening operation of said car doors. The amount the stop member advances when the car doorway is fully opened can be also reduced.

In one example, the stop member has a guide surface that is slanted with respect to the opening/closing direction of the car doors, whereby the stop member advances as the manipulating body and the guide surface come into contact when the car doors are opened.

With the disclosed examples, travel of the car can be reliably prevented while the car doorway is partially or fully open due to the engagement of the stop member with the receiver.

In some examples, the amount of advancement of the stop member toward a hoistway wall is reduced and the space required for the hoistway can be reduced.

The various features and advantages of this invention will become apparent to those skilled in the art from the following detailed description. The drawings that accompany the detailed description can be briefly described as follows.

DETAILED DESCRIPTION

Figure 1:
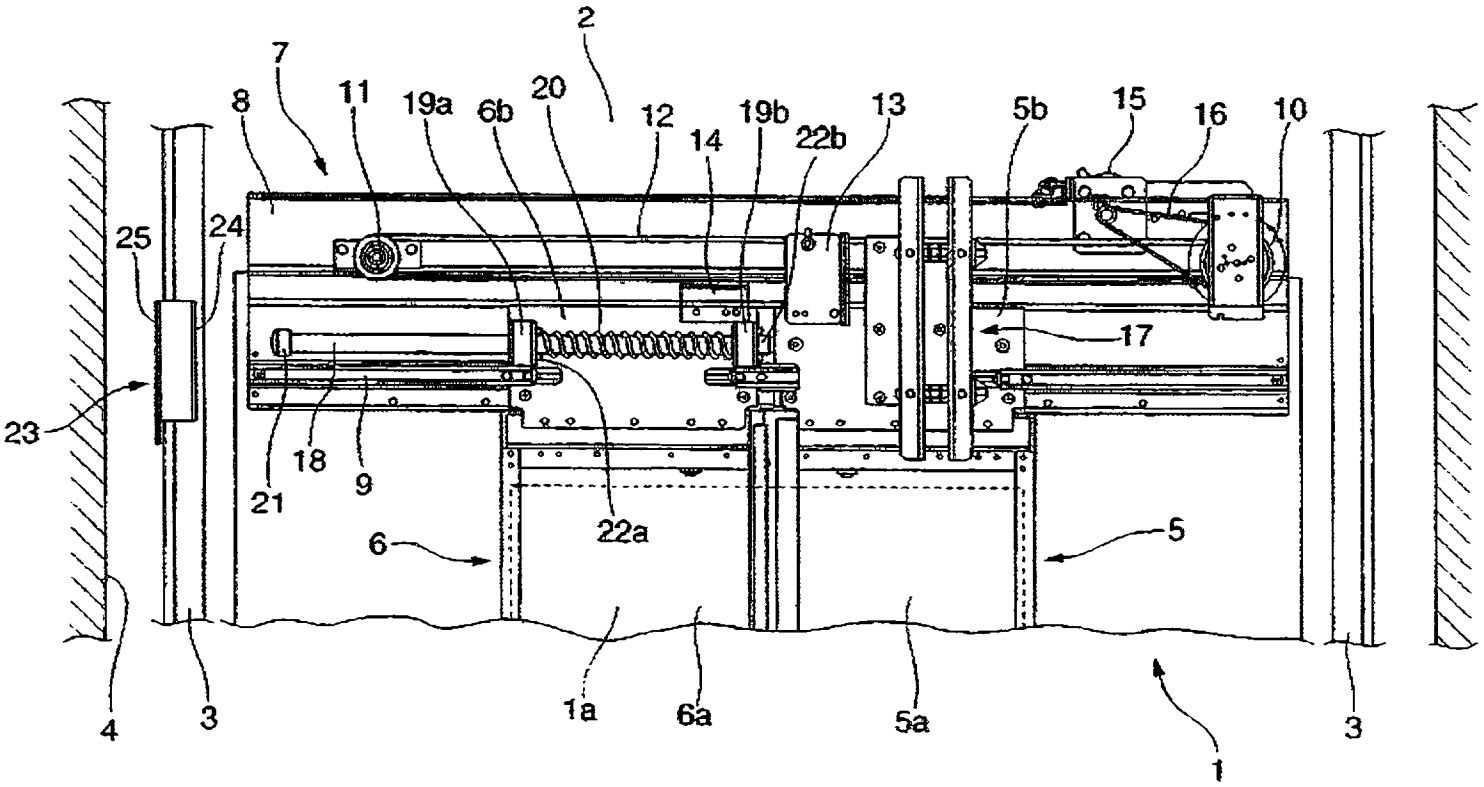
FIG. 1 is a front view of a door opening/closing mechanism as a first embodiment of the present invention when the car-side doorway is fully closed.
Figure 2:
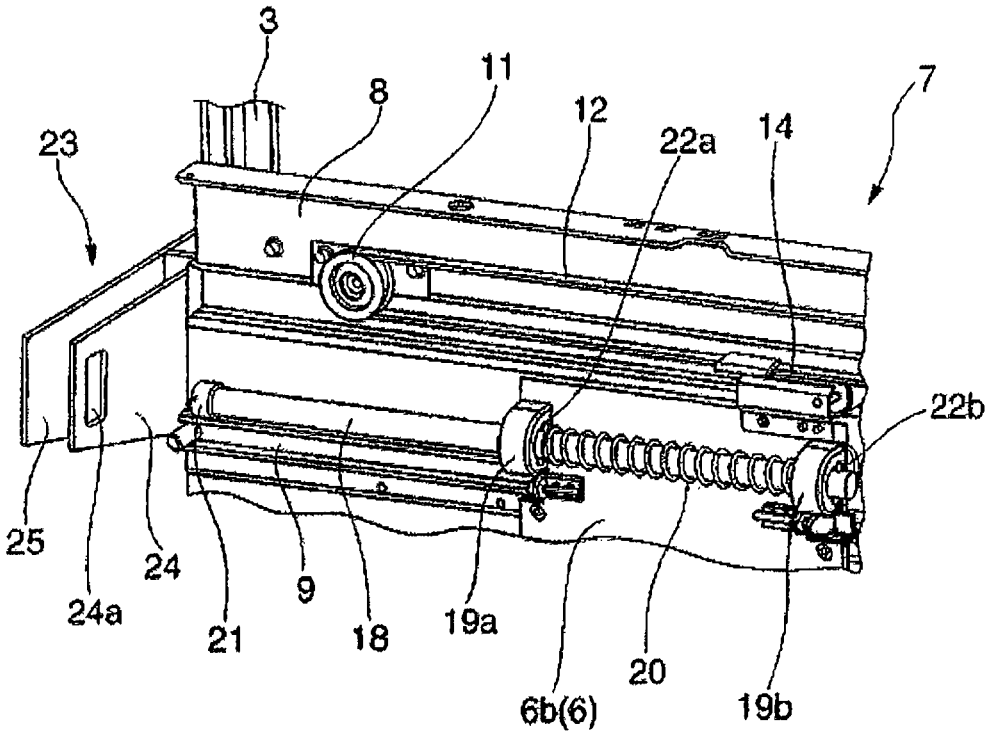
FIG. 2 is an enlarged perspective view of the main part of FIG. 1.
Figure 3:
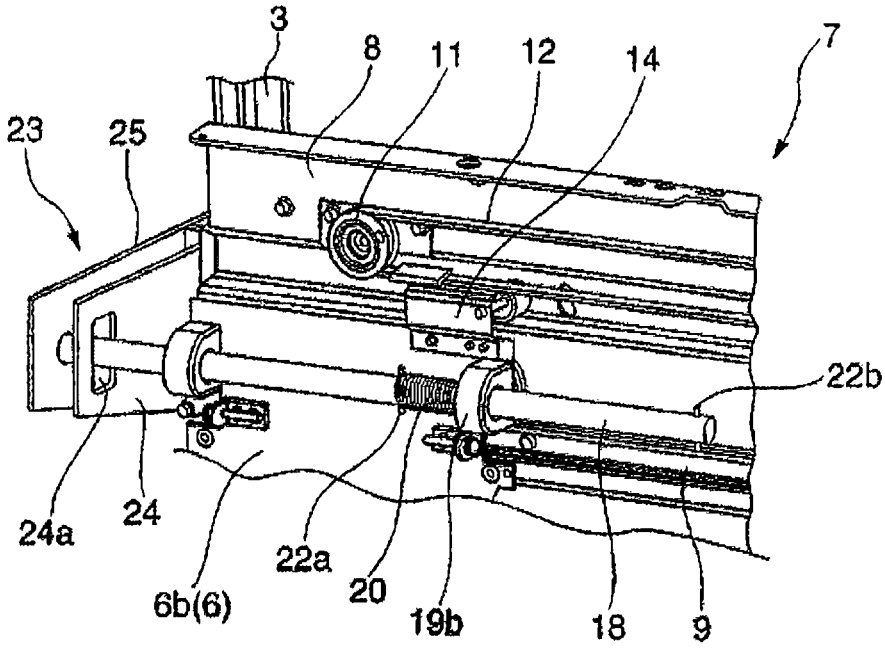
FIG. 3 is a perspective view of the car-side doorway in FIG. 2 when it is fully opened.
Figure 4:
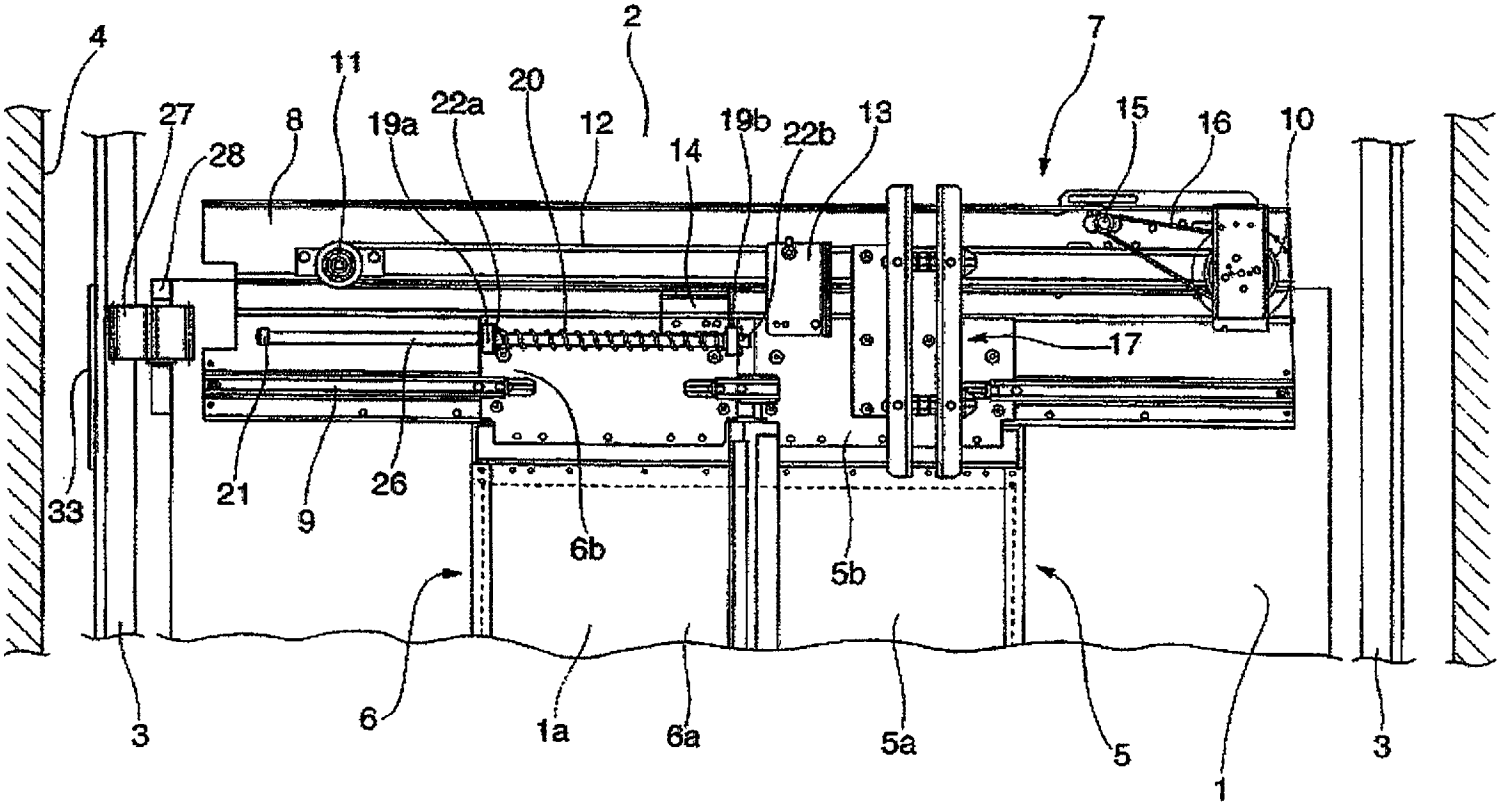
FIG. 4 is a front view of a door opening/closing mechanism as a second embodiment of the present invention when the car-side doorway is fully closed.

FIGS. 1-3 show a first embodiment of a device for preventing travel of an elevator with its doors open. As shown in FIG. 1, two matched standing guide rails 3 are installed in parallel inside hoistway 2, whereby car 1 travels in the vertical direction inside hoistway 2 along said guide rails 3. Here, both guide rails 3 have a generally T-shaped cross section, and they are fixed to hoistway walls 4 using rail brackets (not illustrated).

Car-side doorway 1*a* is created on car 1 in order for passengers to get on/off said car 1, and said car-side doorway 1*a* is opened/closed in the horizontal direction by a matched pair of car-side doors 5 and 6. In this example, a so-called two-leaf door system is adopted as the door opening/closing method for the car-side doors 5 and 6.

Car-side doors 5 and 6 have door panels 5*a* and 6*a* for opening/closing car-side doorway 1*a* and quasi-rectangular door hangers 5*b* and 6*b* that are attached to the top end parts of said door panels, respectively. Car-side doors 5 and 6 are hung from door rails 9 to be described later using not illustrated door rollers that are attached to the back sides of door hangers 5*b* and 6*b*. As is well-known but not illustrated here, guide shoes to be guided by a doorsill are attached to the bottom ends of door panels 5*a* and 6*a*.

On the other hand, door operator 7 in this example is installed at the top of car 1 in order to open/close car-side doors 5 and 6. Door rails 9, which extend in the horizontal direction, are installed on operator base plate 8 of door operator 7;

and deceleration pulley 10 is installed in a rotatable fashion above said door rails 9 at the right end part of operator base plate 8 in FIG. 1, and slave pulley 11 is installed in a rotatable fashion at the left end part of operator base plate 8 in FIG. 1. Endless drive belt 12 is installed between said deceleration pulley 10 and slave pulley 11, and one of the car-side doors 5 and the other car-side door 6 are respectively connected to the upper part of drive belt 12 and the lower part of drive belt 12 via coupling members 13 and 14.

When door motor 15 drives deceleration pulley 10 to rotate via deceleration belt 16, car-side doors 5 and 6 part from each other/come together in the horizontal direction so as to open/close car-side doorway 1*a*. Here, as is well-known, door engagement device 17, which engages with not illustrated landing-side doors, is installed on door hanger 5*b* of car-side door 5 positioned on the right in FIG. 1; and said door engagement device 17 is used to move a landing-side door, not illustrated, in conjunction with car-side door 5.

In addition, a stop rod 18 serves as a stop member to be latched when the car-side doors are opened. The stop rod 18 is installed in the horizontal direction, that is, in the direction that the doors are opened/closed, on the surface of door hanger 6*b* of car-side door 6 positioned on the left in FIG. 1. Two matched support members 19*a* and 19*b*, serve the role of a direct-acting guide means for guiding stop rod 18 in the horizontal direction relative to door hanger 6*b*. A compression coil spring 20 serves the role of a biasing means for constant application of a biasing force to stop rod 18 in the direction in which the doors are opened. The spring 20 and support members 19*a* and 19*b* are installed between stop rod 18 and door hanger 6*b*.

More specifically, as shown in FIG. 2, stop rod 18 runs through support members 19*a* and 19*b* that are fixed to door hanger 6*b*, and compression coil spring 20 is fitted around stop rod 18 between support members 19*a* and 19*b*. A first (left side in FIG. 2) end of the compression spring 20 is received against a first stop pin 22*a* that passes through the stop rod 18. A second (right side in FIG. 2) of the compression spring 20 is received against the support member 19*b*. A second stop pin 22*b*, which also passes through the stop rod 18, is used to define the foremost advancement position of stop rod 18 with respect to door hanger 6*b* in the direction in which the doors are opened as it comes into contact with support member 19*b* provided on the right in FIG. 2. In other words, compression coil spring 20 is installed between first stop pin 22*a* and support member 19*b* provided on the right in FIG. 2. The compression coil spring 20 constantly pushes against the stop rod 18 in the direction in which the doors are opened. Then, when the doors are closed as shown in FIG. 2, stop rod 18 is retained at the foremost advancement position by second stop pin 22*b* and support member 19*b*. Here, buffering member 21 made of rubber is attached to the front end of stop rod 18.

A receiver (stop bracket) 23, which serves the role of a latching member to be engaged with stop rod 18, is attached to guide rail 3. This stop bracket 23 has a latching part 24 including an oblong vertical latching hole 24*a* and an advancement restricting part 25 serving as an advancement restricting means on the side provided counter to stop-rod 18 side of said latching part 24 at a prescribed distance.

In this example, when car 1 arrives at the landing of a servicing floor, and car-side doors 5 and 6 are opened, stop rod 18 initially advances toward the hoistway sidewall 4 together with car-side door 6 which is moved in the direction of opening of the doors. During this initial advancement, the compression spring 20 is not compressed, as the support member 19*b*, compression spring 20, and stop pin 22*a* move together with the door panel 6*a*. Then, at an intermediate stage of door opening, the stop rod 18 moves into latching hole 24*a* and engages with latching part 24. At this time, buffering member 21 of stop rod 18 comes into contact with advancement restricting part 25 at an advancement limit position, whereby further advancement of stop rod 18 is prevented. Once stop rod 18 has reached the advancement limit position, the car-side doors 5, 6 may continue to move further in the direction of opening of the doors while compressing compression coil spring 20 until the car-side doorway is fully opened as shown in FIG. 3. That is, in the present embodiment, because stop rod 18 is engaged with latching part 24 at an intermediate point during the opening operation of the door, travel of the car can be prevented by the engagement of the stop rod 18 in the stop bracket 23, even if car-side doorway 1*a* is only partially open.

In the position shown in FIG. 3, the door is held in place by the door mover so that the support member 19*b* is effectively stationary. The spring 20 urges the stop pin 22*a* away from the support member 19*b* so that the stop rod 18 is urged in the direction of door opening (to the left).

On the other hand, when car-side doors 5 and 6 are instructed to close, first car-side door 6 is initially closed by enabling the compressed coil spring 20 to relax to its uncompressed state while the stop rod 18 remains engaged with the stop bracket 23. Then, at an intermediate point when the coil spring 20 is fully uncompressed, the continued closing of the door 6*b* (by door operator 7) enables the stop rod 18 to retreat along with car-side door 6 to subsequently part from stop bracket 23, whereby car 1 becomes ready to travel. That is, in the present embodiment, the engagement of stop rod 18 with stop bracket 23 is maintained until some intermediate point during the door closing operation of car-side doors 5 and 6, and stop rod 18 is released from stop bracket 23 when a safe state is attained while the door closing operation progresses.

Therefore, according to the present embodiment, because stop rod 18 is reliably engaged with stop bracket 23 when car-side doorway 1*a* is fully open, travel of car 1 with its doors open can be reliably prevented, so the safety of the elevator can be improved.

In particular, because stop rod 18 is not only engaged with stop bracket 23 when car-side doorway 1*a* is fully open but also when car-side doorway 1*a* is partially open, travel of car 1 during the door opening operation of car-side doors 5 and 6 can be reliably prevented, resulting in an advantage that the safety of the elevator can be further improved.

In addition, because the movement of stop rod 18 in the direction of opening of the doors is restricted by advancement restricting part 25 of stop bracket 23 during the door opening operation of car-side door 6 while reducing the relative amount stop rod 18 protrudes from car 1 when car-side door 1*a* is completely open, there is an advantage that the space required for hoistway 2 can be reduced in the horizontal direction.

Furthermore, because travel of car 1 with its doors open can be prevented using a simple structure, that is, installation of stop rod 18 on the front surface of door hanger 6*b*, not only can said mechanism be made smaller and lighter, but also a sufficient maintenance space can be assured in order for service personnel to work and move around during maintenance of the elevator.

FIGS. 4-7 show a second embodiment including a car stop member 27, which is installed in such a manner that it can pivot with respect to the frame of the car in order to serve the role of the member to be latched, is installed in addition to stop rod 26 that is almost the same as that of the first embodiment, whereby stop rod 26 pushes car stop 27 during the door opening operation of car-side doors 5 and 6. That is, in the present embodiment, stop rod 26 functions as a manipulating body used to manipulate car stop 27.

Figure 5:
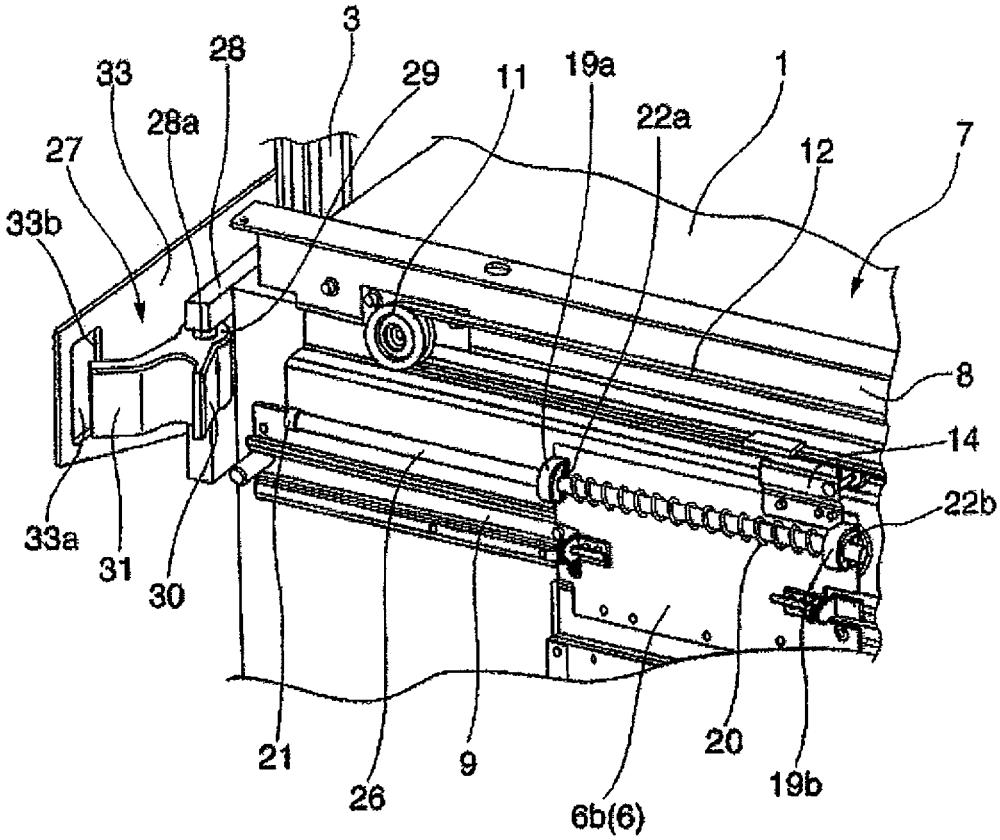
FIG. 5 is an enlarged perspective view of the main part of FIG. 4.
Figure 6:
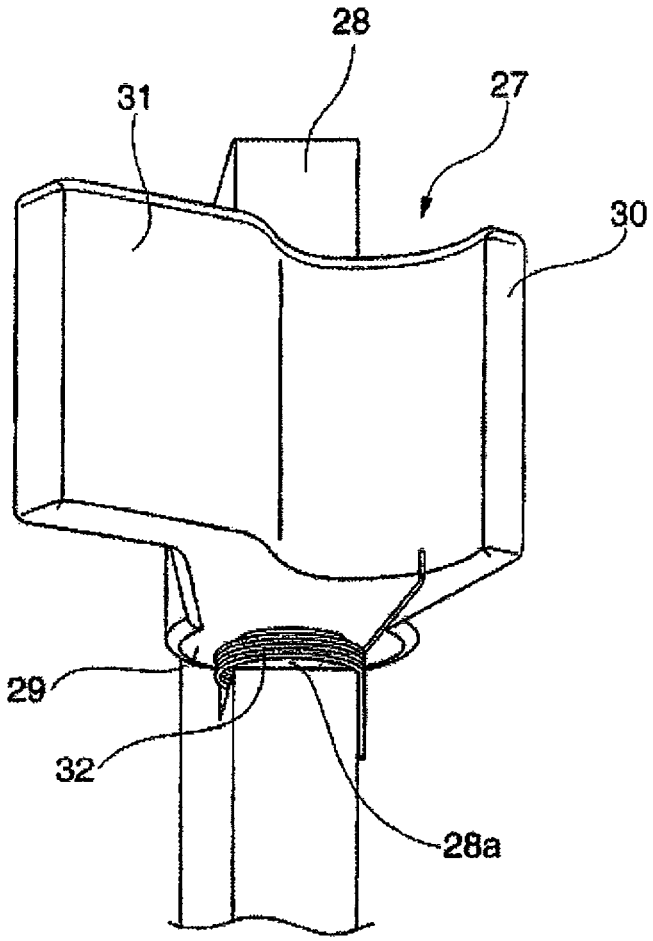
FIG. 6 is a perspective view of the main part of FIG. 5 when it is further enlarged.

More specifically, as shown in FIGS. 5 and 6, bracket 28 having pivot shaft 28*a* in the vertical car direction is attached to a car frame of the car not shown in the figure, and quasi-cylindrical attachment base part 29 of car stop 27 is fitted loosely around pivot shaft 28*a* of bracket 28. Furthermore, push part 30 to be pushed by stop rod 26 and stop part 31 to be engaged with a receiver (stop plate) 33 to be described later are extended in the diameter direction from attachment base part 29. Then, when said car stop 27 pivots with respect to pivot shaft 28*a*, stop part 31 advances toward/retreats from stop plate 33.

In addition, twisted coil spring 32, which serves the role of a biasing means, is provided between stop 27 and bracket 28. Twisted coil spring 32 is retained by bracket 28 at one end while it is retained by push part 30 at the other end. Car stop 27 is constantly biased by said twisted coil spring 32 in the pivoting direction of retreat of stop 31 from the side counter to the side having the stop bracket 33. Here, car stop 27 is held at its retreat limit position using a pivot restricting member (not illustrated) when car-side doorway 1*a* is closed as shown in FIG. 5.

On the other hand, quasi-rectangular latching hole 33*a* with the long side formed in the vertical direction is created on stop plate 33 serving as the latching member fixed to guide rail 3, whereby stop part 31 of car stop 27 can move into said latching hole 33*a*.

Figure 7:
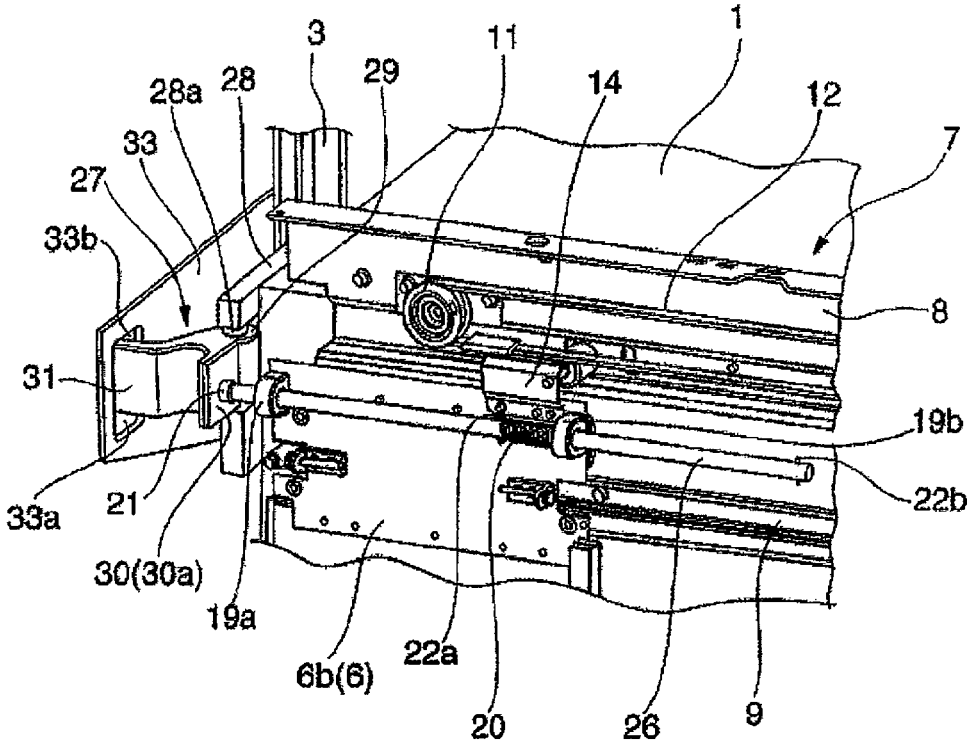
FIG. 7 is a perspective view of the car-side doorway in FIG. 4 when it is fully opened.

Then, when car-side doors 5 and 6 are opened as car 1 arrives at the landing of a floor, stop rod 26, which moves along with car-side door 6, comes into contact with push part 30 of car stop 27 during the door opening operation, and said push part 30 is pushed by stop rod 26 in the direction of opening of the doors. As a result, as shown in FIG. 7, car stop 27 pivots, stop part 31 of said car stop 27 moves into latching hole 33*a*, and outer surface 33*b* of latching hole 33*a* serves the role of an advancement restricting means in order to prevent further advancement of stop part 31 from the advancement limit position, where the front end part of said stop part 31 comes into contact with said outer surface 33*b*. As described above, because further advancement of stop rod 26 is prevented by said car stop 27 once car stop 27 reaches the advancement limit position, the continued opening of the doors 5, 6 causes the compression of coil spring 20 until the car-side doorway is fully opened as shown in FIG. 7.

On the other hand, during the door closing operation of car-side doors 5 and 6, first car-side door 6 is initially moved in the direction of closing of the doors while car stop 27 is retained at the advancement limit position by the pushing operation force of stop rod 26 generated by the biasing force of compression coil spring 20, until the compression spring 20 is fully uncompressed at an intermediate point during the door closing operation. Then, after the intermediate point at which the spring 20 is fully uncompressed, the stop rod 26 is moved, along with the door 6, to the foremost retracted point with respect to door hanger 6*b* by the door operator 7, such that car stop 27 pivots in the direction of retreat of stop part 31 due to the biasing force of twisted coil spring 32. As a result, stop part 31 parts from stop plate 33, and car 1 becomes ready for travel.

Therefore, according to the present embodiment, not only can almost the same effect as that of the first embodiment be achieved, but an advantage is also offered in terms of strength in that because car stop 27 is supported by the frame of the car, the force preventing travel of the car is borne by the frame of the car.

Figure 8:
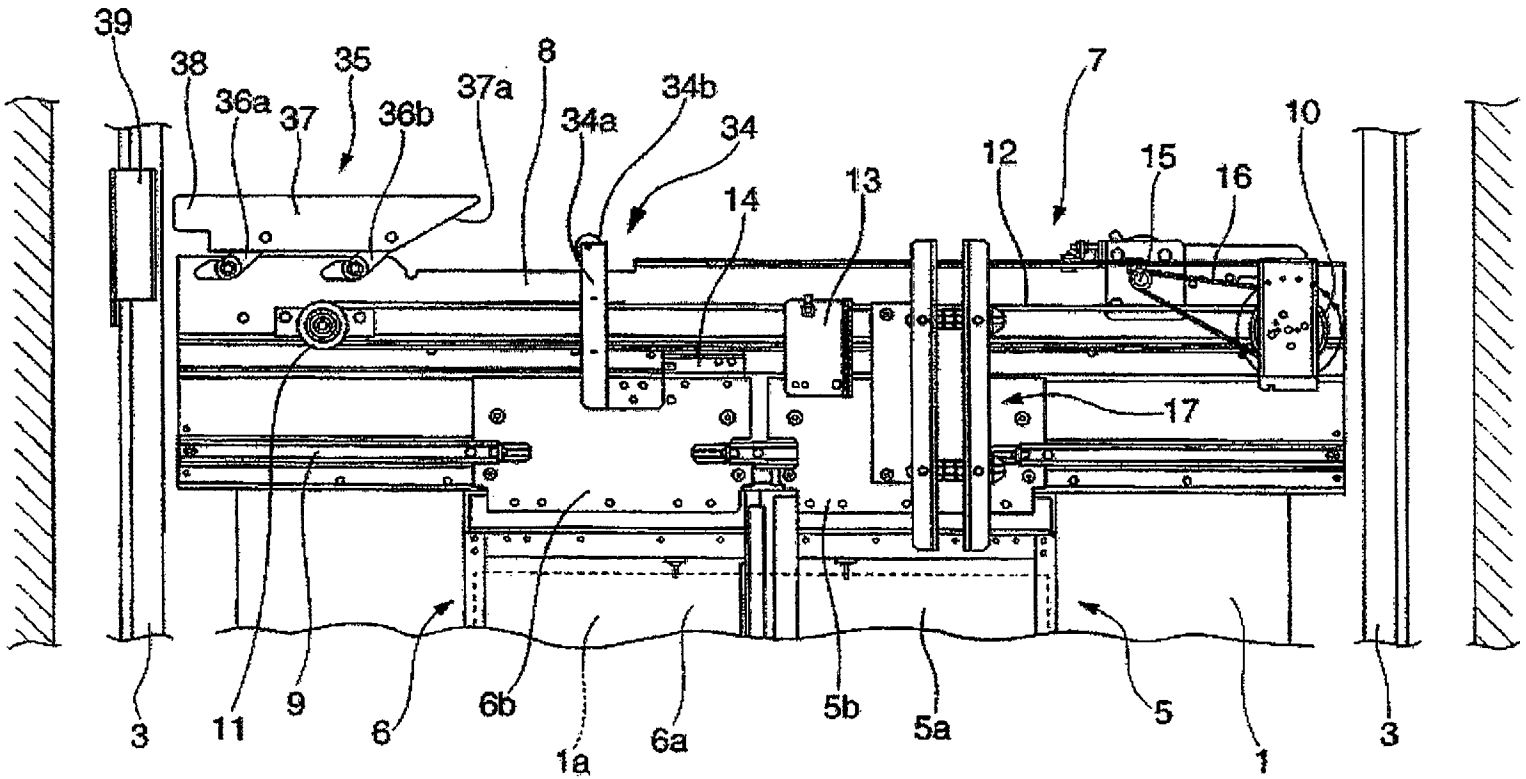
FIG. 8 is a front view of a door opening/closing mechanism as the third embodiment of the present invention when the car-side doorway is fully closed.
Figure 9:
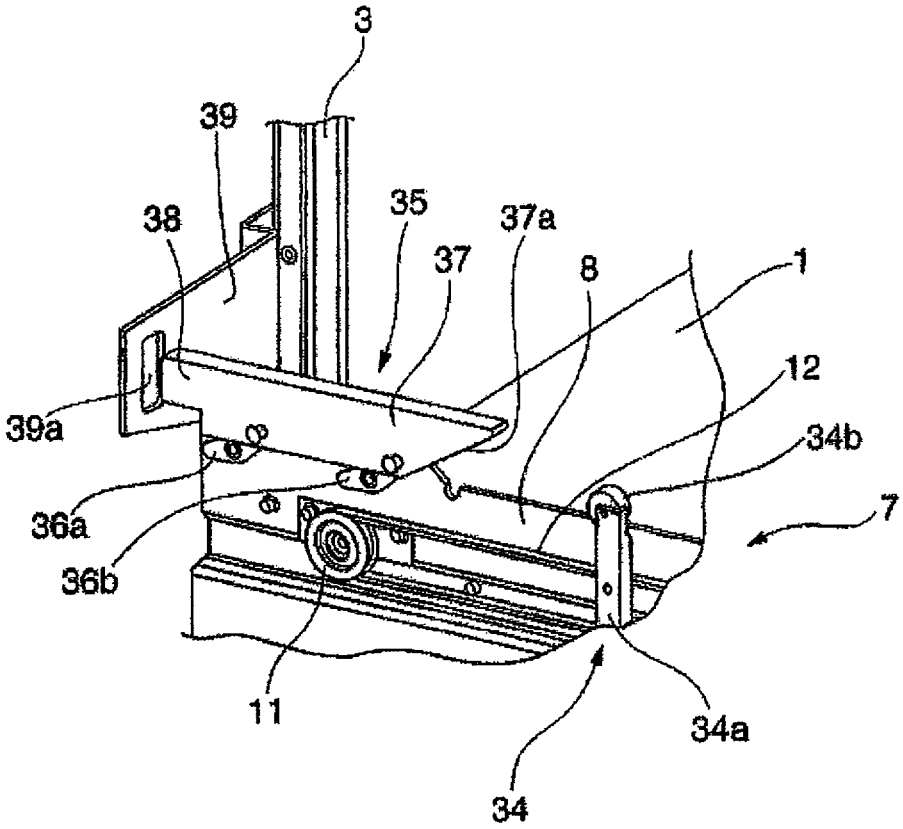
FIG. 9 is an enlarged perspective view of the main part of FIG. 8.
Figure 10:
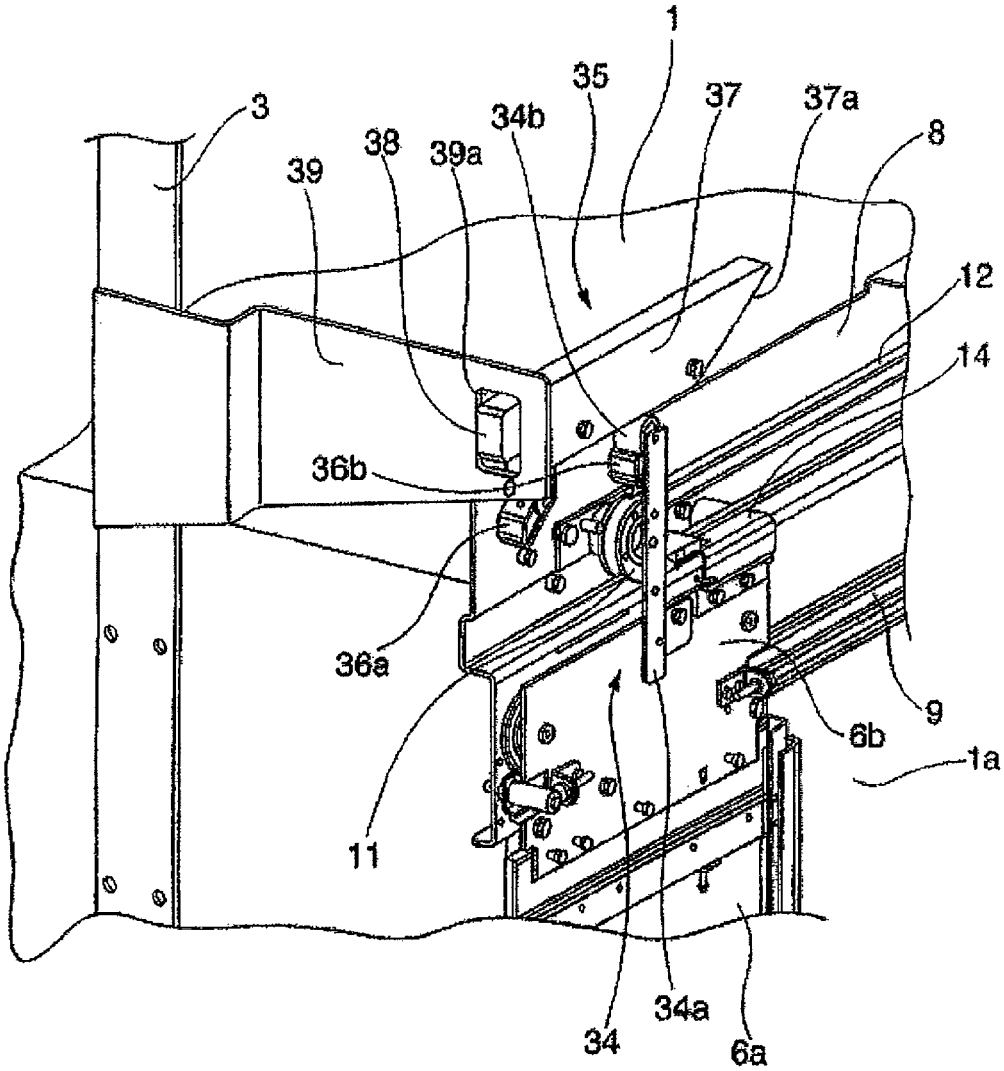
FIG. 10 is an enlarged perspective view of the main part of FIG. 8, wherein the condition of the car-side doorway when it is fully opened is shown.

FIGS. 8-10 are diagrams showing a third embodiment in which a bottom part of a vertically extending attachment plate 34*a* of a manipulation body 34 is fixed to door hanger 6*b*, and roller 34*b* is installed at the top of said attachment plate 34*a* in a rotatable fashion. On the other hand, car stop member 35, which serves the role of the stop member to be latched, is connected to the top end part of operator base plate 8 at the left end part in FIG. 8 via linking members 36*a* and 36*b*. That is, car stop 35, linking members 36*a* and 36*b*, and operator base plate 8 are used to configure a parallel linking mechanism that utilizes operator base plate 8 as a fixation node, whereby car stop 35 is allowed to retreat toward a receiver (stop plate) 39 to be described later while it is guided by linking members 36*a* and 36*b*. Here, car stop 35 is biased constantly by the weight of car stop 35 itself in the direction of closing of car-side door 6, and it is retained at the retreat limit position by a pivoting restricting member not illustrated while in the state shown in FIG. 8 in which car-side doorway la is fully closed.

More specifically, as shown in FIG. 9, car stop 35 has quasi-trapezoidal plate main body 37 and protrusion part 38 that extends from said stop main body 37 toward the stop plate 39 side, and guiding surface 37*a* as the end surface counter to the stop plate 39 side of stop main body 37 is formed slanting downward in the direction of opening of car-side door 6.

On the other hand, quasi-rectangular latching hole 39*a* with the long side formed in the vertical direction is created on stop plate 39 that serves the role of a latching member fixed to guide rail 3.

In the case of a device for preventing travel of an elevator with its doors open that is configured in the aforementioned manner, when car-side doors 5 and 6 are opened when car 1 arrives at the landing of a floor, car stop 35 is cam-driven at an intermediate point during the opening operation by manipulating body 34, which is moved along with car-side door 6, so as to advance toward the stop plate 39. More specifically, at the intermediate point during the door opening operation, the roller 34*b* of manipulating body 34 reaches the guiding surface 37*a* of the car stop 35. Subsequently, the continued door opening operation causes the roller 34*b* to ride down the guiding surface 37*a*, thereby forcing linking members 36*a* and 36*b* to pivot upward so as to move car stop 35 by a prescribed amount toward stop plate 39 side and resultantly enable protrusion part 38 of said stop 35 to move into latching hole 40*a* of stop plate 39 as shown in FIG. 10. Travel of car 1 is prevented when car stop 35 engages with stop plate 39 in said manner. Then, once car stop 35 is engaged with stop plate 39, roller 34*b* is moved along the bottom surface of stop main body 37 while the engagement between car stop 35 and stop plate 39 is maintained as car-side doors 5, 6 are further moved in the direction of opening of the doors until car-side doorway 1*a* is fully opened.

On the other hand, during the door closing operation of car-side doors 5 and 6, the roller 34*b* of manipulating body 34 initially rolls along the bottom surface of the car stop member 35 until an intermediate point at which the roller 34*b* then rolls up the guiding surface 37*a* so as to lower car stop 35. As the car stop 35 is lowered the linking members 36*a* and 36*b* pivot thereby enabling the protrusion part 38 of car stop 35 to part from stop plate 39, and car 1 becomes ready for travel.

Therefore, also in the present embodiment, almost the same effect as that of the first embodiment can be achieved.

Furthermore, although the device for preventing travel of an elevator with its doors open was applied to a so-called a two-leaf door system, which involves two biparting doors, used as the door opening/closing system in the first to the third embodiments, the present invention can also be applied to an elevator that utilizes a so-called single-opening door system as the door opening/closing system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for preventing travel of an elevator car when at least one elevator car door is open, comprising:

at least one receiver that remains in a fixed position relative to a hoistway wall;

a stop member that moves responsive to movement of the car door toward an open position such that the stop member engages the receiver to prevent movement of the elevator car when the car door is open;

a biasing member that applies a biasing force to the stop member to urge the stop member in a direction corresponding to movement of the car door toward an open position; and a restricting member that limits an amount of movement of the stop member in the direction such that the stop member is prevented from moving by the restricting member before the car door reaches a fully open position.

2. The device of claim 1, wherein the stop member is supported on the car door such that the stop member moves with the car door.

3. The device of claim 1, wherein the receiver includes an opening through which the stop member is at least partially received.

4. The device of claim 1, wherein the biasing member maintains the stop member stationary in a position where the stop member is engaged with the receiver during at least a portion of a movement of the car door toward a closed position.

5. The device of claim 1, wherein the stop member is supported on a frame of the elevator car.

6. The device of claim 1, wherein the stop member comprises a rod that moves in direction parallel to movement of the door.

7. The device of claim 6, wherein a portion of the rod moves beyond a boundary of the elevator car to engage the receiver.

8. The device of claim 1, wherein the stop member comprises a car stop that is moveable relative to a frame of the car and a manipulating member that causes movement of the car stop responsive to movement of the car door such that the car stop engages with the receiver;

the car stop is supported for moving pivotally relative to the frame of the car; and the car stop engages the receiver before the car door reaches a fully opened position.

9. The device of claim 1, wherein the restricting member prevents the stop member from moving in the direction while the elevator car door is moving toward the open position.

10. The device of claim 9, wherein the restricting member prevents the stop member from moving as the elevator car door reaches an intermediate position as the elevator car door moves toward the open position.

11. The device of claim 1, wherein the stop member remains stationary during at least some movement of the elevator car door toward the open position.

12. The device of claim 11, wherein the stop member remains stationary as the elevator car door moves from an intermediate position to the open position; and the intermediate position is between the open position and a closed position.

13. The device of claim 1, wherein the stop member remains stationary during at least some movement of the elevator car door toward a closed position.

14. The device of claim 13, wherein the stop member remains stationary as the elevator car door moves from the open position to an intermediate position; and the intermediate position is between the open position and the closed position.

15. The device of claim 1, wherein the biasing member comprises a spring.

16. The device of claim 15, wherein the spring comprises a coil spring that is configured to expand in a direction that results in the biasing force.

17. The device of claim 16, wherein the coil spring is compressed when the restricting member prevents the stop member from moving and the elevator car door moves toward the open position.

18. The device of claim 17, wherein the coil spring urges the stop member against the restricting member when the elevator car door is between an intermediate position and the open position; and the intermediate position is between the open position and a closed position.

19. The device of claim 17, wherein the coil spring holds the stop member essentially stationary as the elevator car door moves between the open position and an intermediate position between the open position and a closed position.

* * * * *